US010526106B2

(12) United States Patent
Carman

(10) Patent No.: US 10,526,106 B2
(45) Date of Patent: Jan. 7, 2020

(54) BULK BIN, BULK BIN SLEEVE PACK, AND RELATED METHOD

(71) Applicant: Inteplast Group Corporation, Livingston, NJ (US)

(72) Inventor: Gregory A. Carman, Victoria, TX (US)

(73) Assignee: Inteplast Group Corporation, Livingston, NJ (US)

( * ) Notice: Subject to any disclaimer, the term of this patent is extended or adjusted under 35 U.S.C. 154(b) by 74 days.

(21) Appl. No.: 15/395,108

(22) Filed: Dec. 30, 2016

(65) Prior Publication Data

US 2018/0186508 A1 Jul. 5, 2018

(51) Int. Cl.
*B62D 5/32* (2006.01)
*B65D 5/32* (2006.01)

(52) U.S. Cl.
CPC ..... *B65D 5/321* (2013.01)

(58) Field of Classification Search
CPC ... B65D 11/1866; B65D 11/18; B65D 11/188; B65D 19/06
USPC ..... 229/122.21, 195, 198.2, 147–149, 152, 229/153
See application file for complete search history.

(56) References Cited

U.S. PATENT DOCUMENTS 697,668 A 4/1902 Schleicher
2,167,917 A 8/1939 Vogt
2,709,547 A * 5/1955 Niedringhaus ..... B65D 19/02 108/55.3
2,799,458 A 7/1957 Nye
3,034,697 A 5/1962 Frankenstein
3,058,775 A 10/1962 Schliephacke
3,525,466 A 8/1970 Robinson
3,791,002 A 2/1974 Lampe et al.
3,869,079 A 3/1975 Oglesbee
3,876,073 A 4/1975 Herbetko
4,017,019 A * 4/1977 Booth ..... B65D 5/106 229/113
4,085,847 A 4/1978 Jacalone
4,089,417 A 5/1978 Osborne
4,105,153 A 8/1978 Locke
4,119,266 A 10/1978 Dempster
4,131,228 A 12/1978 Barry
4,386,729 A 6/1983 Schmidt
4,441,649 A 4/1984 Nederveld
(Continued)

FOREIGN PATENT DOCUMENTS

CA 2047652 1/1993
DE 3703018 A1 8/1987
(Continued)

*Primary Examiner* — Andrew T Kirsch
*Assistant Examiner* — Don M Anderson
(74) *Attorney, Agent, or Firm* — Stinson LLP

(57) ABSTRACT

A sleeve pack for forming a bulk bin includes a base for forming a bottom of the bulk bin and a perimeter wall assembly. The perimeter wall assembly includes two blanks that can be connected to one another at interlocking connections to form a perimeter wall of the bulk bin. Locking tabs are associated with at least one of the wall blanks, and corresponding locking openings are associated with at least one other of the wall blanks. The openings oppose the tabs and the tabs are lockingly inserted into the openings to secure the wall members together to form the perimeter wall of the bulk bin.

18 Claims, 7 Drawing Sheets

(56) References Cited

U.S. PATENT DOCUMENTS

| | | | |
|---|---|---|---|
| 4,454,946 | A | 6/1984 | Yokowo |
| 4,561,587 | A | 12/1985 | Wysocki |
| 4,606,461 | A | 8/1986 | Stanley |
| 4,830,270 | A | 5/1989 | Holmes |
| 4,883,221 | A | 11/1989 | Brundage |
| 5,000,372 | A | 3/1991 | Hollander et al. |
| 5,163,609 | A | 11/1992 | Muise, Jr. |
| 5,467,916 | A | 11/1995 | Beales |
| 5,485,951 | A | 1/1996 | Phillips |
| 5,509,620 | A | 4/1996 | Crews |
| 5,597,084 | A | 1/1997 | Parasin |
| 5,735,483 | A | 4/1998 | Bierlein |
| 5,743,422 | A | 4/1998 | Hale |
| 5,791,590 | A | 8/1998 | Zuk et al. |
| 6,364,200 | B1 | 4/2002 | Moss et al. |
| 6,371,363 | B1 | 4/2002 | Franklin et al. |
| 6,386,437 | B1 | 5/2002 | Larson, Jr. |
| 6,575,398 | B2 | 6/2003 | Nakamura et al. |
| 6,688,514 | B2 | 2/2004 | Evans et al. |
| 7,278,565 | B2 | 10/2007 | West |
| 7,467,743 | B1 | 12/2008 | Philips |
| 7,654,440 | B2 | 2/2010 | Quaintance et al. |
| 8,091,770 | B2 | 1/2012 | McLeod |
| 8,205,787 | B2 | 6/2012 | Panduro, Jr. et al. |
| 9,213,367 | B1 * | 12/2015 | Nelson ..... G06F 1/1628 |
| 9,290,290 | B2 | 3/2016 | Carman |
| 9,556,000 | B2 | 1/2017 | Carman |
| 2017/0029163 | A1 | 2/2017 | Olds et al. |

FOREIGN PATENT DOCUMENTS

| | | | |
|---|---|---|---|
| DE | 29502721 | U1 | 8/1995 |
| EP | 2565140 | A1 | 3/2013 |
| EP | 2634127 | A1 | 9/2013 |
| GB | 2165214 | A | 4/1986 |

* cited by examiner

BULK BIN, BULK BIN SLEEVE PACK, AND RELATED METHOD

FIELD

The present invention generally relates to bulk bins and more particularly to a sleeve pack configured to be selectively erected as a bulk bin and selectively collapsed for storage when in disuse.

BACKGROUND

Bulk bins, which are sometimes referred to as bulk boxes, Gaylord bins, skid boxes, pallet boxes, octabins, etc., are commonly used for storing and shipping bulk quantities of goods. Typically, bulk bins are erected on pallets so that a forklift can move a bin while it is filled with goods. In an erected configuration, a bulk bin defines a large interior volume for receiving and containing goods in bulk. Some bulk bins are selectively collapsible for storing the bulk bin in a more space-efficient manner when it is not being used.

Certain bulk bins are formed from sleeve packs. Bulk bin sleeve packs typically include a base and two separate wall members that are arranged to form a perimeter wall of the bulk bin. The two wall members can be permanently secured to one another to form the perimeter wall using an adhesive or the like, but doing so prevents the wall members from being collapsed separately for storage when they are not in use. The wall members can also be held together by a separate connection assembly, but these require additional pieces that can be cumbersome to install and remove when deploying and storing the sleeve pack.

SUMMARY

In one aspect, a bulk bin sleeve pack for being repeatably erected to form a bulk bin having a bottom wall and a perimeter wall and collapsed when not in use comprises a base configured to form the bottom wall of the bulk bin. A first wall member is configured to form a portion of the perimeter wall of the bulk bin. The first wall member has a bottom edge margin configured for attachment to the base, a top edge margin, and first and second side margins. A second wall member is configured to form another portion of the perimeter wall of the bulk bin. The second wall member has a bottom edge margin, a top edge margin, and first and second side margins. The bottom edge margin of the second wall member is configured for attachment to the base so that the first side margin of the first wall member overlaps the second side margin of the second wall member and the second side margin of the first wall member overlaps the first side margin of the second wall member. Locking tabs are associated with at least one of the first and second wall members. The locking tabs are located at respective side margins of the first and second wall members. Locking openings are associated with at least one of the first and second wall members. The locking openings are located at respective side margins of the first and second wall members. The locking openings oppose the locking tabs when the first and second wall members are attached to the base to form the perimeter wall of the bulk bin. The locking tabs are configured to be lockingly inserted into the locking openings to secure the first and second wall members together to form the perimeter wall of the bulk bin.

In another aspect, a bulk bin comprises a base having a perimeter. A perimeter wall assembly extends circumferentially around a bulk bin interior and has a top edge margin and an opposite bottom edge margin arranged adjacent the perimeter of the base such that the base defines a bottom end of the bulk bin interior. The perimeter wall assembly comprises a first wall member having a first side margin and a second side margin and a second wall member having a first side margin and a second side margin. The perimeter wall assembly comprises a first interlocking connection securing together the first side margin of the first wall member and the second side margin of the second wall member and a second interlocking connection securing together the second side margin of the first wall member and the first side margin of the second wall member. The first interlocking connection includes first and second openings formed in the first side margin of the first wall member and first and second locking tabs extending from the second side margin of the second wall member. The first and second tabs extend through respective ones of the first and second openings and lock the first and second wall members together. The second interlocking connection includes third and fourth openings in the first side margin of the second wall member and third and fourth locking tabs extending from the second side margin of the first wall member. The third and fourth tabs extend through respective ones of the third and fourth openings and lock the first and second wall members together.

In another aspect, a method of making a bulk bin sleeve pack comprises forming from a blank a first wall member including a first side margin having a first opening adjacent to a top edge margin of the first wall member and a second opening adjacent to a bottom edge margin of the first wall member and including a second side margin having a first locking tab adjacent to the top edge margin and a second locking tab adjacent to the bottom edge margin. A second wall member substantially identical to the first wall member is formed from the blank. A base having a perimeter is formed from a blank. The first and second wall members are sized and shaped for attachment to the base to form a perimeter wall on the base so that the first and second openings of the first side margin of the first wall member are aligned with the first and second tabs on the second side margin of the second wall member. The first and second openings on the first side margin of the second wall member are aligned with the first and second tabs of the second side margin of the first wall member.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
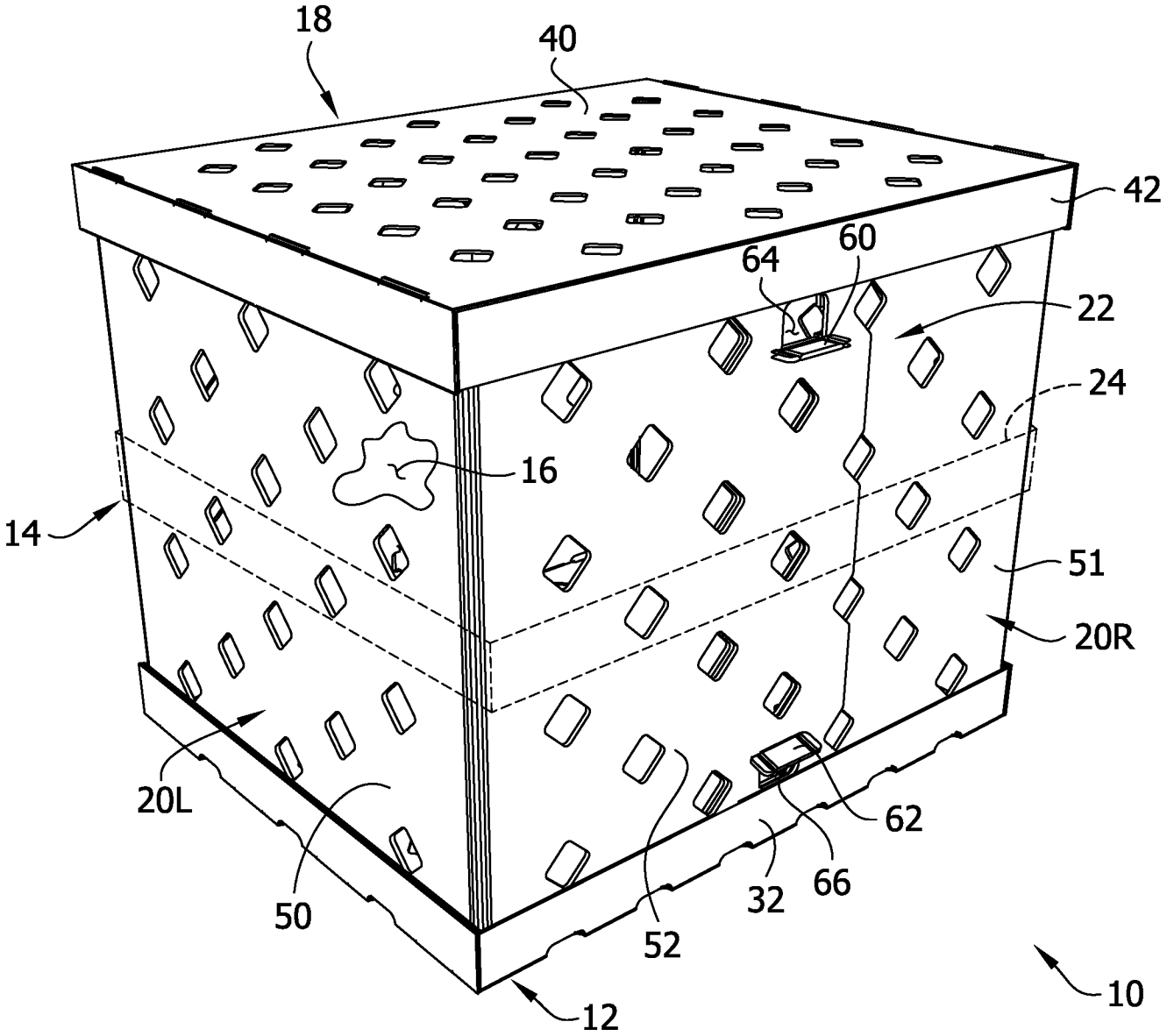
FIG. 1 is a perspective of a bulk bin sleeve pack in a erected configuration with a portion of a perimeter wall broken away to reveal a bulk bin interior.

Referring to FIG. 1, a bulk bin sleeve pack in an erected configuration is generally indicated at reference number 10. As will be explained in further detail below, the sleeve pack 10 can be selectively and repeatably disassembled from the erected configuration of FIG. 1 to a collapsed configuration shown in FIG. 2 when the bulk bin is not in use. Referring to FIG. 1, the erected bulk bin 10 includes a bottom tray (broadly, a base), generally indicated at 12, which forms the floor or bottom end of the bulk bin. The erected bulk bin 10 also includes a perimeter wall assembly, generally indicated at 14, which extends circumferentially around a bulk bin interior 16, and a top tray, generally indicated at 18, placed over the bulk bin interior to form a lid or top end of the bulk bin. The perimeter wall assembly 14 comprises left and right wall members 20L, 20R. Throughout this disclosure, terms such as front, back, left, and right refer to the orientation of various features of the sleeve pack as shown in FIG. 1, and the signifiers F, B, L, R are appended to the reference numbers of certain features that are positioned toward the front, back, left, and right, respectively, of the bulk bin 10 as shown in FIG. 1. It is understood that the orientation and position of these features will vary in use. As explained in further detail below, the wall members 20L, 20R are formed form separate blanks that define mating interlocking formations configured to form first and second interlocking connections, the first of which is generally indicated at 22 and the second of which is blocked from view by the perimeter wall assembly 14. A strap 24 (shown in broken line in FIG. 1) can also be secured about the perimeter wall assembly 14 to further gird the perimeter wall against lateral loads imparted on the bulk bin 10 in use. Below, each of components of the sleeve pack 10 is described in detail before describing the use of the sleeve pack, including its deployment and storage.

Figure 2:
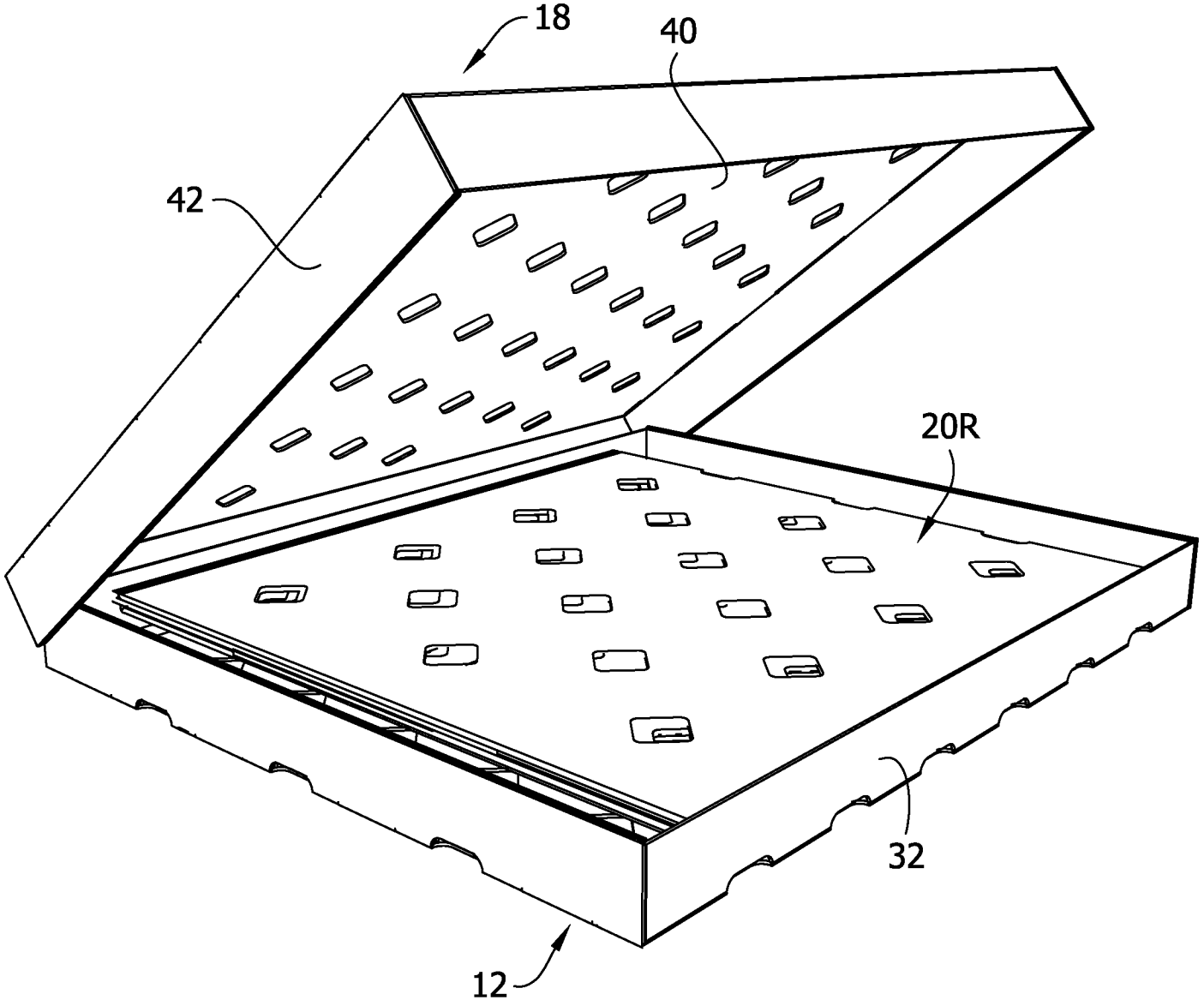
FIG. 2 is a perspective of the bulk bin sleeve pack in a collapsed configuration.
Figure 3:
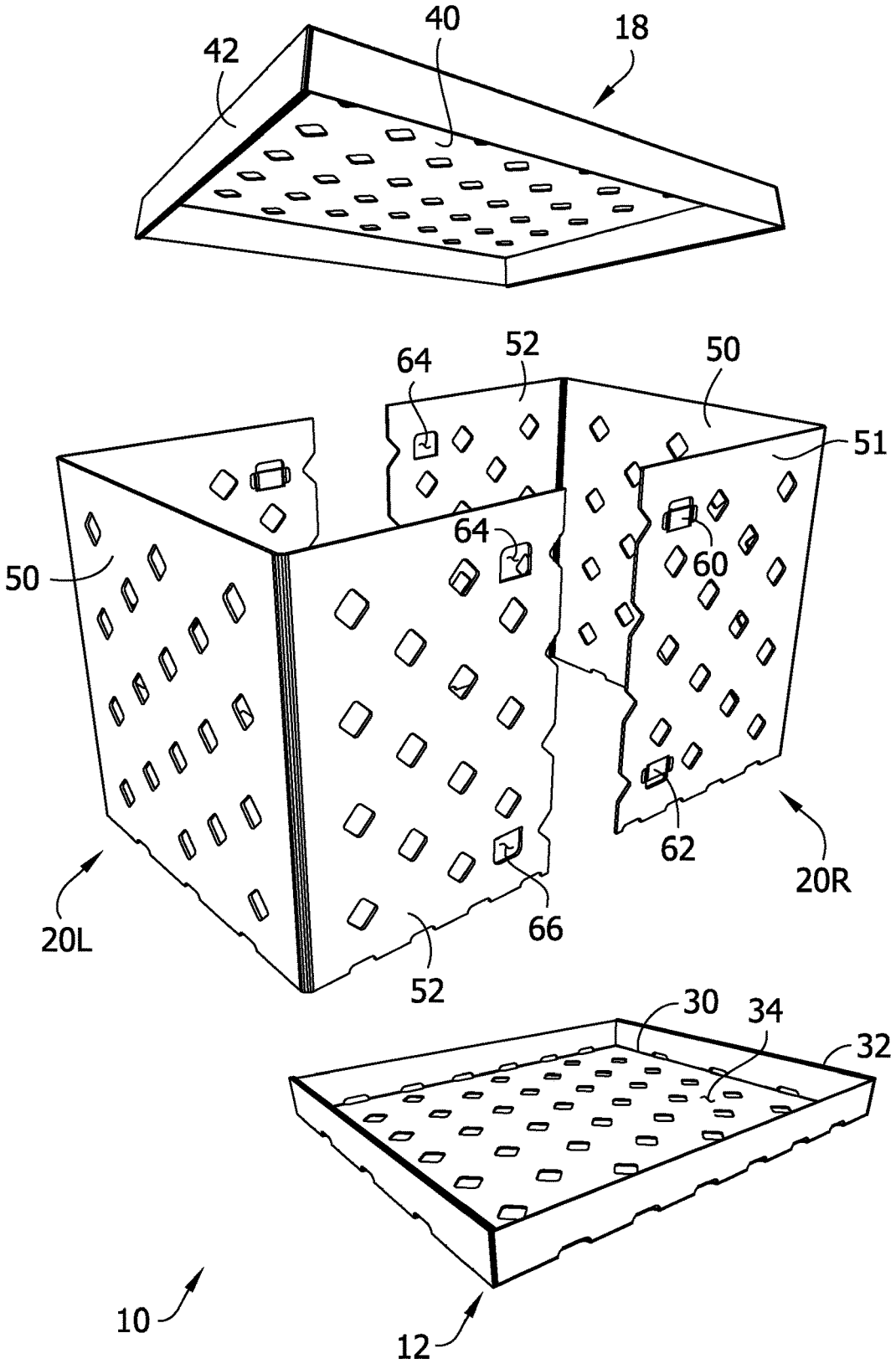
FIG. 3 is an exploded perspective of the bulk bin sleeve pack.
Figure 4:
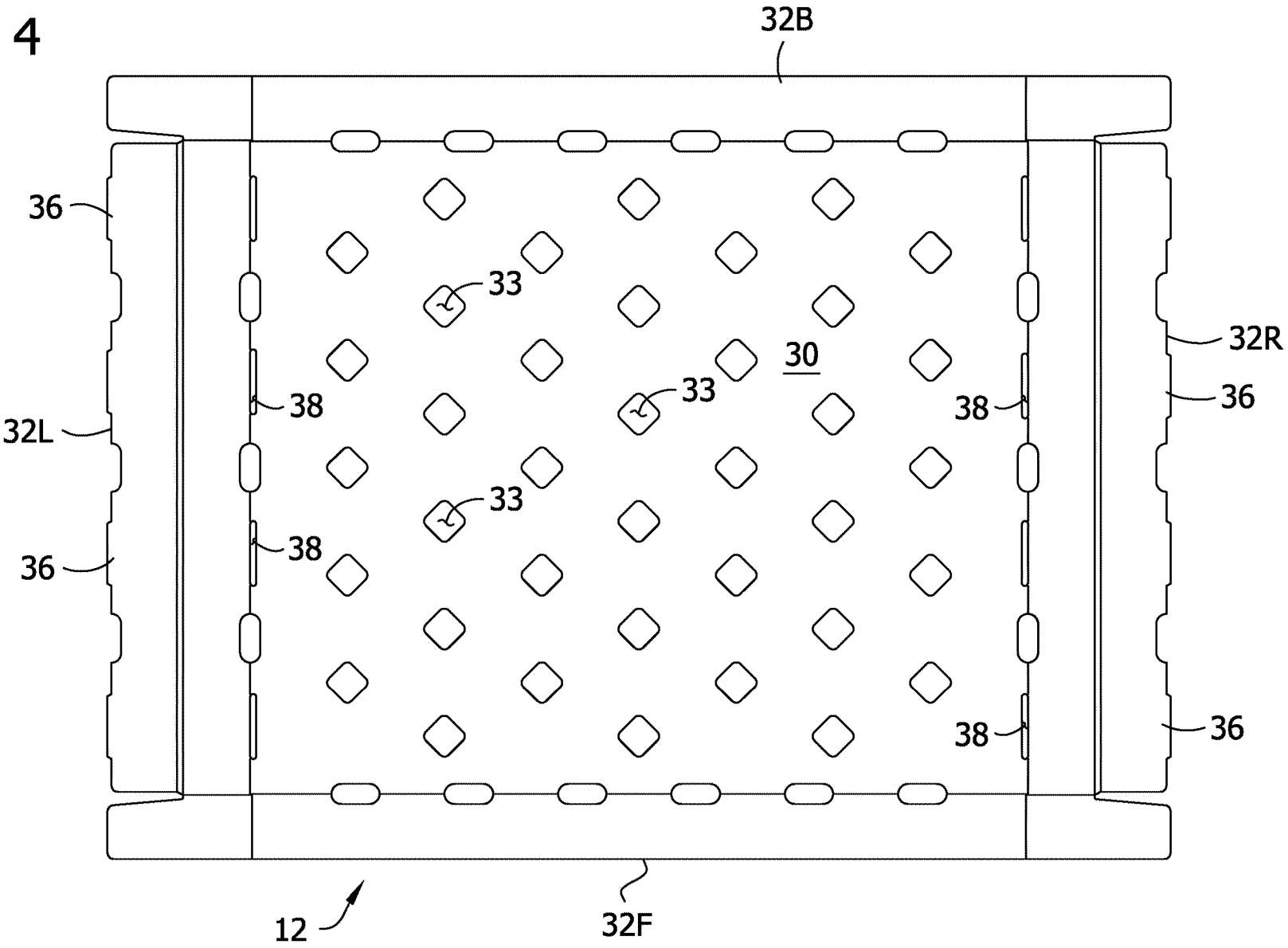
FIG. 4 is a plan view of a bottom tray blank of the bulk bin sleeve pack.

Referring to FIGS. 3 and 4, the bottom tray 12 is assembled from a blank (FIG. 4) to form a tray (FIG. 3) comprising a bottom panel 30 and a rim 32 extending upward from the bottom panel. Holes 33 are formed in the bottom panel 30 to allow fluid flow (e.g., air or water flow) into and out of the bulk bin interior 16 through the bottom end of the bulk bin 10. The rim 32 defines a perimeter of the bottom tray 12 and extends circumferentially around a storage cavity 34 that is shaped and arranged for receiving the collapsed left and right wall members 22L, 22R in the collapsed configuration (FIG. 2; the left wall member 22L is positioned below and concealed by the right wall member 22R in FIG. 2). In the erected configuration, a bottom edge margin of the perimeter wall assembly 14 is arranged adjacent the perimeter of the bottom tray such that the bottom panel 30 defines a bottom boundary of the bulk bin interior 16. More specifically, in the illustrated embodiment, the bottom edge margin of the perimeter wall assembly 14 nests inside in the storage cavity 34 with no fixed connection between the bottom tray 12 and the perimeter wall assembly. It will be understood that a bottom tray can be connected to the perimeter wall assembly in other ways in other embodiments, such as using a nesting relationship in which the bottom tray is nested inside the perimeter wall or using removable fasteners, a hinged connection, etc.

As mentioned above, the bottom tray 12 is formed from a blank as shown in FIG. 4. The bottom tray blank 12 comprises a single board that is stamped or otherwise formed to define the bottom panel 30 and a plurality of rim panels 32F, 32B, 32L, 32R that are foldably connected to the bottom panel to form the rim 32. In one or more embodiments, the bottom tray is formed from a single board of fluted plastic material, but other materials may also be used without departing from the scope of the invention. For example, in certain embodiments one or more components of the sleeve pack can be formed from a polymer bubble board such as the materials disclosed in U.S. Design Pat. Nos. D771,841 and D772,437, which are hereby incorporated by reference in their entireties. The rim panels include a left rim panel 32L for forming a left end of the rim 32, a right rim panel 32R for forming a right end of the rim, a front rim panel 32F for forming a front side of the rim, and a back rim panel 32B for forming the back side of the rim. To assemble the bottom tray 12 from the blank, the front and back rim panels 32F, 32B are folded up from the bottom panel 30 along respective fold lines (indicated in dotted line) and left and right corner portions of each are folded inward until they are generally aligned with left and right edges of the bottom panel. The left and right end panels 32L, 32R are subsequently folded up along fold lines defining the left and right edges of the bottom panel 30 and inward along additional fold lines over the left and right corner portions of the front and back side panels 32F, 32B. Protrusions 36 projecting from the left and right end panels 32L, 32R are received in corresponding slots 38 formed along the end edges of the bottom panel 30 to secure the panels in position to form the rim 32.

Figure 5:
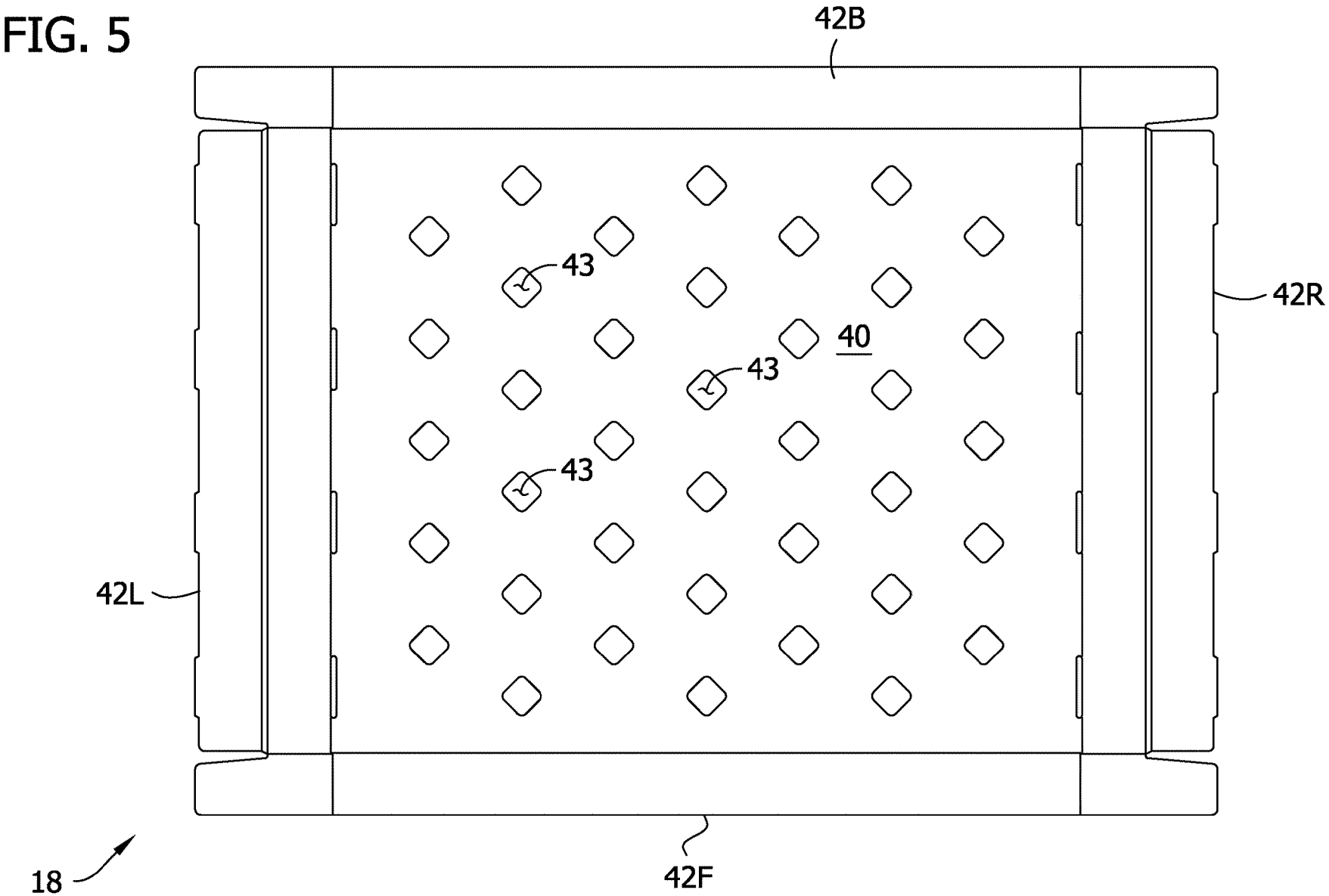
FIG. 5 is a plan view of a top tray blank of the bulk bin sleeve pack.

Referring to FIGS. 1, 3, and 5, the top tray 18 is constructed similar to the bottom tray 12 to form a lid or cover that can be selectively placed over the bulk bin interior 16 in the erected configuration (FIG. 1) or placed over the storage cavity 34 in the collapsed configuration (FIG. 2). Like the bottom tray 12, the top tray 18 is assembled from a blank (FIG. 5) to form a tray (FIG. 3) comprising a top panel 40 and a rim 42 extending downward from the top panel. As shown in FIG. 5, the top tray blank 18 includes a top panel 40 and front, back, left, and right rim panels 42F, 42B, 42R, 42L that are foldably connected to the top panel in the same manner as the front, back, left, and right rim panels 32F, 32B, 32R, 32L are connected to the bottom panel 30. Thus, the rim panels 42F, 42B, 42R, 42L are configured to be folded to form the rim 42 in the same sequence described above for the rim panels 32F, 32B, 32R, 32L. In the illustrated embodiment, the top panel 40 of the top tray 18 is slightly larger than the bottom panel 30 of the bottom tray 12 so that the bottom tray 12 and wall panels 20L, 20R can be received within the top tray in the collapsed configuration (FIG. 2). When the top tray 18 is installed as a cover over the open top end of the bulk bin 10 in the erected configuration, a top edge margin of the perimeter wall assembly 14 is arranged adjacent the perimeter of the top tray such that the top panel 40 defines a top boundary of the bulk bin interior 16. More specifically, the top edge margin of the perimeter wall assembly 14 nests inside the rim 42 with no fixed connection between the top tray 12 and the perimeter wall assembly. Accordingly, the top tray 18 can be quickly installed and removed as a cover or lid over the open top end of the bulk bin 10 in use. And when the top tray 18 is installed, holes 43 formed in the top panel 40 allow fluid flow into and out of the bulk bin interior 16 through the top of the bulk bin 10. It will be understood that in other embodiments, a sleeve pack can include another type of top member or cover or be free of a cover without departing from the scope of the invention.

Figure 6:
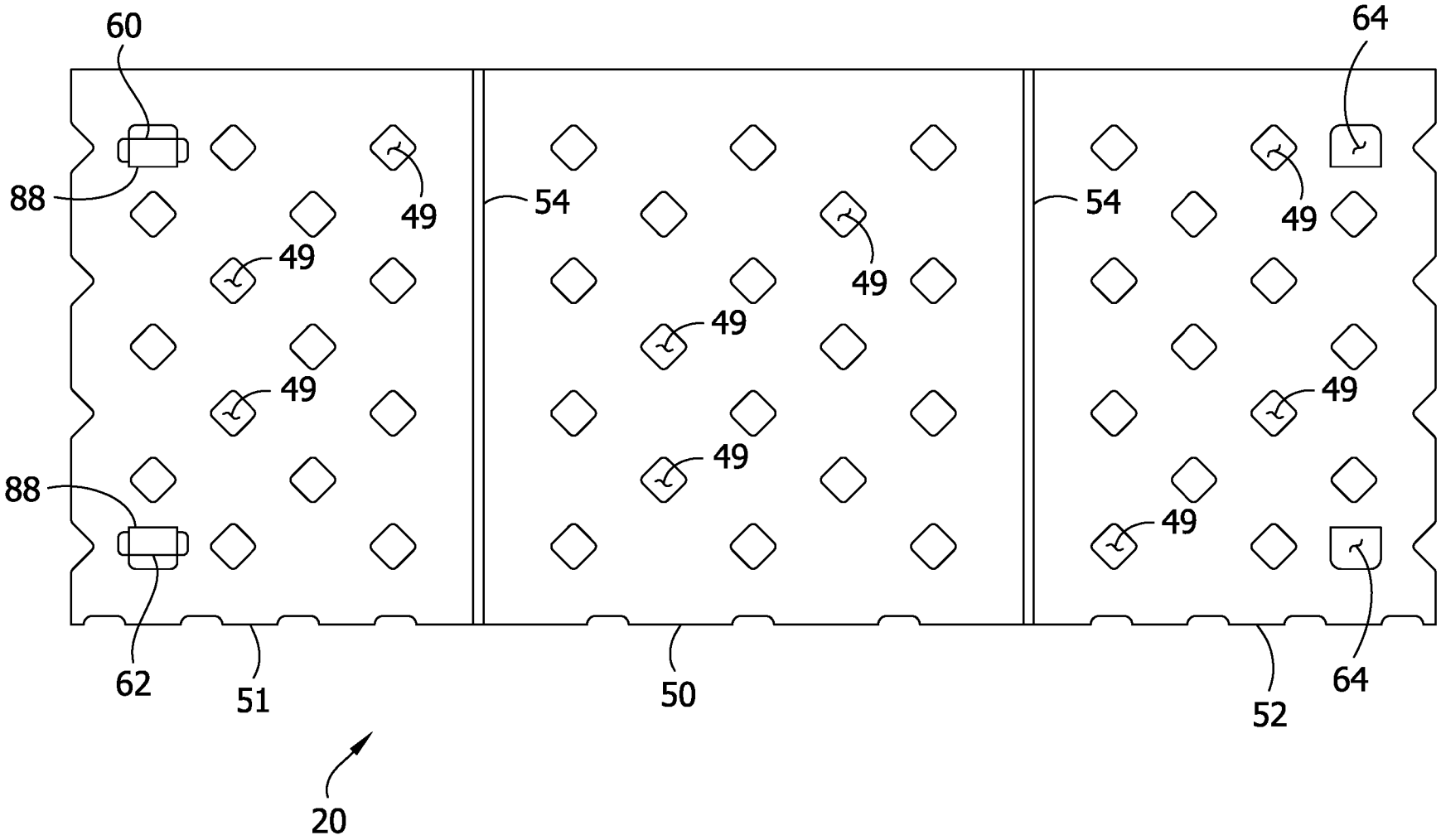
FIG. 6 is a plan view of a wall member blank of the bulk bin sleeve pack.

Referring to FIGS. 3 and 6, the left and right wall members 20L, 20R are formed form two identical wall member blanks 20 (FIG. 6) that are folded so that each forms a generally rectilinear U-shape when viewed from the top or bottom end of the bulk bin 10 in the erected configuration. The two identical blanks 20 are folded in opposite orientations to form the erected left and right wall members 20L, 20R. The features of the blank 20 shown in FIG. 6 and discussed in further detail below are common to both the left wall member 20L and the right wall member 20R. Although the illustrated embodiment uses identical blanks to form the left and right wall members 20L, 20R, it will be understood that in other embodiments, the wall members could be formed from blanks of different constructions without departing from the scope of the invention.

Referring to FIG. 6, each wall member blank 20 is suitably formed of a single board having a top edge margin, a bottom edge margin, and a height extending therebetween. In one or more embodiments, the board that forms the blank 20 comprises a fluted plastic material, but other materials may also be used without departing from the scope of the invention. In the illustrated embodiment, a plurality of fluid flow holes 49 extend through the thickness of the blank 20 to promote fluid flow through the bulk bin interior 16 when the bulk bin sleeve pack 10 is erected.

The blank 20 includes a central panel 50 and first and second end panels 51, 52 are hingedly connected to the sides of the central panel. In one or more embodiments, living hinges are established along fold lines 54 formed in the blank 20 at the junctures between the central panel 50 and the first and second side panels 51, 52. The fold lines 54 can be formed by, e.g., heat scoring the fluted plastic material along the fold lines or by using a crease-forming machine, such as the Wegener Welding Crease-Folding Machine Model ESP 2000, available from Wegener Welding LLC in Burr Ridge, Ill. Suitably, the blank 20 is sufficiently flexible along the fold lines 54 to permit the left and right side wall members 20L, 20R to be folded in a substantially flat, three-layer configuration for storage (FIG. 2). For example, in an exemplary collapsed configuration, the first side panel 51 is folded under the central panel 50 and the second side panel 52 is folded over the central panel so that the three panels are arranged adjacent one another and extend in substantially parallel planes. The first side panel 51 defines a first side margin of the blank 20 and the second side panel 52 defines a second side margin of the blank. As explained in further detail below, locking formations are formed in the first and second panels 51, 52 for forming interlocking connections 22 that, in the erected configuration, secure the first side margin of the left wall member 20L in overlapping engagement with the second side margin of the right wall member 20R and the second side margin of the left wall member in overlapping engagement with the first side margin of the right wall member.

The illustrated wall member blank 20 includes an upper locking tab 60 and a lower locking tab 62 that are formed in the first side panel 51 at spaced apart locations along the height of the first side margin of the blank. The second side panel 52 defines an upper opening 64 and a lower opening 66 at spaced apart locations along the height of the second side margin of the blank that are generally aligned with the upper locking tab 60 and the lower locking tab 62 along the height of the blank 20. The upper tab 60 and the upper opening 64 are each located adjacent the top edge margin of the blank and the lower locking tab 62 and the lower opening 66 are each located adjacent the bottom edge margin of the blank. As explained in further detail below, when the bulk bin 10 is erected as shown in FIG. 1, the locking tabs 60, 62 of the right wall panel 20R are configured to be lockingly pushed through the openings 64, 66 of the left wall panel 20L to form the front interlocking connection 22 between the first side margin of the right wall panel and the second side margin of the left wall panel. Likewise, the locking tabs 60, 62 of the left wall panel 20L are configured to be lockingly pushed through the openings 64, 66 of the right wall panel 20R to form the back interlocking connection 22 (not shown) between the first side margin of the left wall panel and the second side margin of the right wall panel.

Although the illustrated wall blank 20 uses upper and lower locking tabs 60, 62 formed along the first side margin and upper and lower openings 64, 66 formed along the second side margin to form the first and second interlocking connections 22, it will be understood that other embodiments can use other arrangements of locking tabs and mating openings to form the connections. For example, other numbers of locking tabs and mating openings can be used to form each interlocking connection and/or the edge margins of the blank may be formed with different arrangements of tabs and openings without departing from the scope of the invention.

Figure 7A:
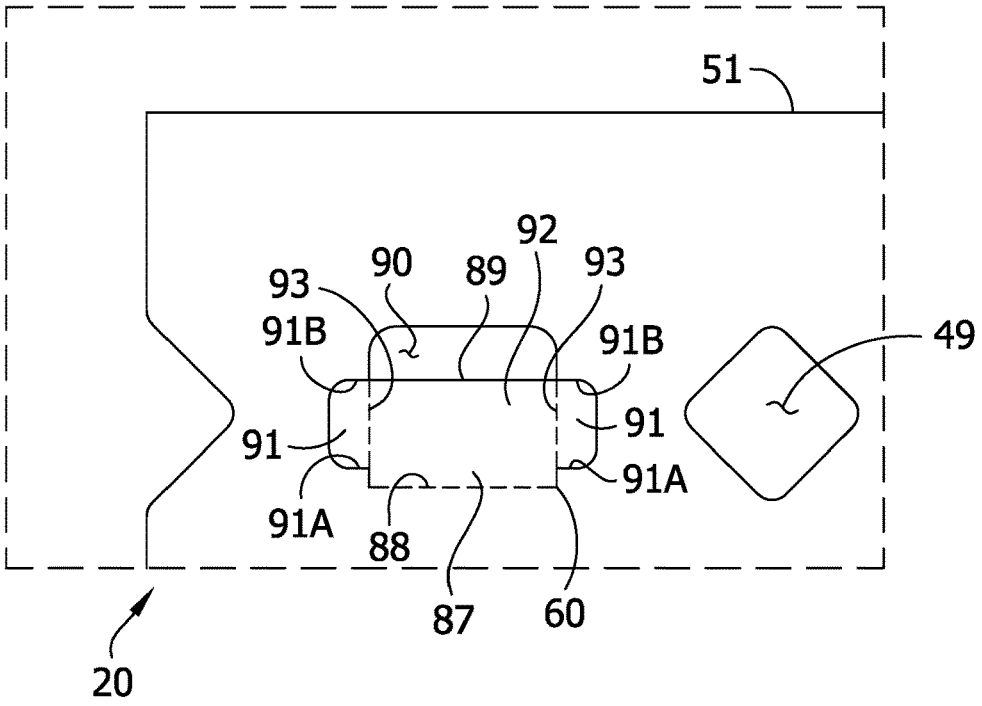
FIG. 7A is an enlarged view of a portion of FIG. 6 illustrating an upper locking tab of the wall member blank.
Figure 7B:
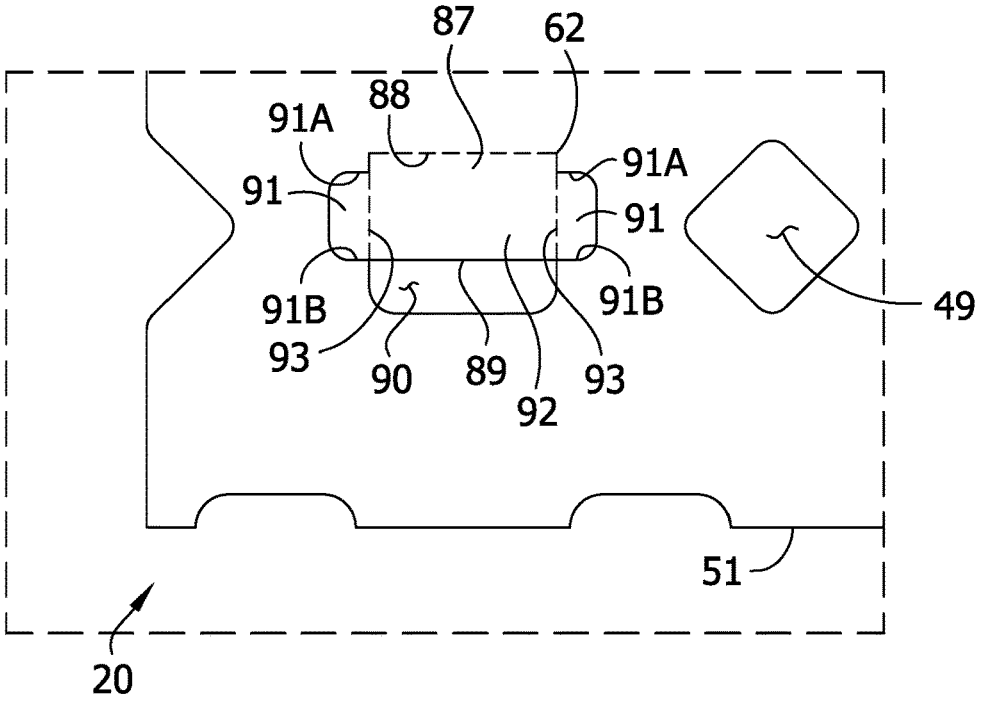
FIG. 7B is an enlarged view of a portion of FIG. 6 illustrating a lower locking tab of the wall member blank.

Referring to FIGS. 7A and 7B, the tabs 60, 62 are configured to be selectively and repeatably pushed into and removed from the openings 64, 66 (e.g., at least about 25 times) without materially damaging the blanks 20 to an extent that they are no longer suitable for reuse. Each tab 60, 62 in the illustrated embodiment is formed by a generally three-sided cutout in the first end panel 51 defining a narrow neck portion 87 adjacent a fold joint 88 and a wider interlocking portion 89 toward the free end of the tab. The fold joint 88 of the upper tab 60 is formed along the bottom end of the tab and the fold joint of the lower tab 62 is formed along the top end of the tab. In addition to the three-sided tab cutout, a portion of the first side panel 51 just past the free end of each tab 60, 62 is cut away to provide a space 90 for grasping and manipulating the tab in use.

The openings 64, 66 in the illustrated embodiment are generally rectangular shape and have a height and a width. The width of the openings 64, 66 are narrower than the respective interlocking portions 89 of the tabs 60, 62 so that the interlocking portions push through the openings lockingly engage adjacent portions of the second side panel 52. The heights of the openings 64, 66 are longer than the respective tabs 60, 62 to provide space for grasping and manipulating the tabs when they are inserted through the openings.

The interlocking portion 89 of each tab 60, 62 includes wing portions 91 that extend outward from a spine portion 92 generally aligned with the neck portion 87. The wing portions 91 define a width of the tab 60, 62 that is wider than the width of the corresponding opening 64, 66. Accordingly, the wing portions 91 must be deformed or bent to pass through the openings 64, 66. In one or more embodiments, as described in U.S. Pat. No. 9,290,290, which is hereby incorporated by reference in its entirety, the fluted plastic material of the blank 20 is oriented so that the flutes extend generally parallel to the spine portions 92 to define resilient living hinges along fold lines 93 between the spine portions and the wing portions 91. When the tabs 60, 62 are pushed through the openings 64, 66, the second side panel 52 engages the wings 91 and bends the wings along the fold lines 93 to fit the tabs through the openings. After being inserted through the openings 64, 66, the tabs 60, 62 are configured to resiliently return toward their original configuration (e.g., by unbending along the fold lines 93 to a configuration in which the wing portions 91 are substantially planar with the neck portion 87) to lockingly engage the second side panel 52 adjacent the openings. As shown in FIG. 1, the tabs 60, 62 can extend substantially perpendicular to the overlapping panels 51, 52 in the erected position. In this configuration, inner ends 91A (FIGS. 7A and 7B) of the wing portions 91 lockingly engage the second wall panel 52 adjacent the opening 64, 66 in which the tab is received to prevent the tabs 60, 62 from being withdrawn back through the opening 64, 66.

The inner ends 91A of the wing portions 91 suitably define tapered inner corners (e.g., corners that are radiused, beveled, etc.) and outer ends 91B of the wing portions likewise define tapered outer corners. The tapered outer corners help facilitate inserting the tabs 60, 62 through the respective holes 64, 66 during deployment by gradually bending the wing portions 91 away from their planar orientation as the tabs pass through the holes to form the interlocking connections 22. Likewise, the tapered inner corners help facilitate removing the tabs by gradually bending the wing portions 91 away from their planar orientation as the tabs pass through the holes to disconnect or separate the interlocking connections 22 between the left and right side wall members 24.

Referring to FIG. 1, any suitable strap 24 may be used to gird the perimeter wall assembly 14 of the bulk bin 10 in use. For example, in one or more embodiments, the strap 24 comprises a ratchet strap or a strap with a buckle connection. In still other embodiments, the strap 24 can be formed from a flexible, elongate strip of material that has selectively interlockable ends. Suitably, the ends of the strap can be selectively clasped or fastened together to gird the perimeter wall assembly 14 in the erected position and the ends of the strap can be selectively disconnected to disassemble the sleeve pack 10 for storage. It is understood that the bin 10 could be erected using only the interlocking connections 22 and without using a strap.

Having described the components of the bulk bin sleeve pack 10, deployment and storage of the bulk bin will now be described in greater detail. In general, it can be seen that the sleeve pack 10 comprises several separate components configured for selective deployment as a bulk bin. To erect the sleeve pack, the bottom tray 12 and the top tray 18 are assembled from the respective blanks. In addition, the left wall member 20L and the right wall member 20R are folded along the fold lines 54 to the U-shaped configurations shown in FIG. 3. In this configuration, the left wall member 20L is arranged so that its central panel 50 forms the left end of the bulk bin 10, its first side panel 51 forms a portion of the back side of the bulk bin, and its second side panel 52 forms a portion of the front side of the bulk bin. The right wall member 20R is similarly arranged so that its central panel 50 forms the right end of the bulk bin 10, its first side panel 51 forms a portion of a front side of the bulk bin, and its second side panel 52 forms a portion of the back side of the bulk bin.

To assemble the perimeter wall assembly 14, the left and right wall members 20L, 20R are positioned in heightwise alignment and so that the first side margin of the left wall member is arranged in overlapping engagement with the second side margin of the right wall member along the back side of the bulk bin and the second side margin of the left wall member is arranged in overlapping engagement with the first side margin of the right wall member along the front side of the bulk bin. In this position, the locking tabs 60, 62 of left wall member 20L are generally aligned with the openings 64, 66 of the right wall member 20R at the back side of the bulk bin 10 and the locking tabs of the right wall member are generally aligned with the openings of the left wall member at the front side of the bulk bin. To establish front and back interlocking connections 22, each pair of tabs 60, 62 is pushed through the aligned openings 64, 66 of the other panel 20L, 20R. As explained above, as the tabs 60, 62 are inserted, the wing portions 91 resiliently bend away from their planar configurations to fit through the openings 64, 66. And when the tabs 60, 62 are fully inserted, the wing portions 91 resiliently return toward the planar configuration and the inner ends 91A lockingly engage portions of the respective second side panel 52 adjacent the mating opening 64, 66. At each interlocking connection, the tabs 60, 62 are suitably bent along the fold lines 88 to be oriented substantially perpendicular to the overlapping side margins of the wall members. The perpendicular tab orientation is thought to provide maximum resistance to inadvertent disengagement of the interlocking connections. If desired, the strap 24 can be fastened around the perimeter wall assembly 14 to further gird the connection between the left and right wall members 20L, 20R.

Before or after the perimeter wall assembly 14 is fully assembled, the left and right wall members 20L, 20R can be arranged so that the bottom edge margins thereof are nested with the rim 32 of the bottom tray 12. The nesting relationship between the perimeter wall assembly 14 and the bottom tray establishes a sufficiently strong connection for loading goods in the bulk bin interior 16.

In use, the interior 16 of the bulk bin 10 is loaded with goods. Because the bulk bin 10 is made of fluted plastic boards that are formed to include fluid flow holes 33, 43, 49 the bulk bin is well-suited for receiving moist or damp goods such as produce. If desired, when the interior 16 of the bulk bin 10 is filled, the top tray 18 can be placed as a covering over the open top end of the bin. In this configuration, the top edge margin of the perimeter wall assembly 14 is nested in the rim 42 of the top tray.

When the bulk bin 10 is no longer needed, the sleeve pack can be disassembled and configured for storage. The top tray 18 and the strap 24 are removed, and the perimeter wall assembly 14 is separated from the bottom tray 12. To separate the left and right wall members 20L, 20R, the tabs 60, 62 are withdrawn from the openings 64, 66. As the tabs are withdrawn, the wing portions 91 resiliently bend to allow the tabs 60, 62 to fit through the respective openings 64, 66. When the tabs 60, 62 are removed, the left and right wall panels 20L, 20R are separated from one another. To collapse the wall panels 20L, 20R, the side panels 51, 52 are folded along the fold lines 54 into overlapping engagement with the central panel 50. In one embodiment, the wall panels 20L, 20R are folded to have a flattened S-shaped cross-sectional configuration wherein one of the side panels 51, 52 lies underneath the central panel 50 and the other overlies the central panel.

When the side wall panels 20L, 20R are collapsed for storage the user places one on top of the other in the storage cavity 34 of the bottom tray 12. To enclose the storage cavity 34, the user places the top tray 18 over the bottom tray 12 so that the rim 32 of the bottom tray nests inside the rim 42 of the top tray 18.

As can be seen, the illustrated bulk bin sleeve pack 10 can be selectively and repeatedly collapsed and erected. The process described above for assembling the bulk bin 10 for deployment and subsequently disassembling it for storage can be repeated several times without damaging the sleeve pack, and in particular, without damaging the interlocking formations 60, 62, 64, 66 at the connections 22 between the left and right wall members 20L, 20R. By using tabs 60, 62 and openings 64, 66 that are integral to the wall members 20L, 20R, the sleeve pack 10 provides self-contained connection structure that simplifies assembly.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A bulk bin sleeve pack for being repeatably erected to form a bulk bin having a bottom wall and a perimeter wall and collapsed when not in use, the bulk bin sleeve pack comprising:

a base configured to form the bottom wall of the bulk bin;

a first wall member configured to form a portion of the perimeter wall of the bulk bin, the first wall member having a bottom edge margin configured for attachment to the base, a top edge margin, and first and second side margins, each of the first and second side margins comprising a respective terminal edge; and a second wall member configured to form another portion of the perimeter wall of the bulk bin, the second wall member having a bottom edge margin, a top edge margin, and first and second side margins, each of the first and second side margins comprising a respective terminal edge, the bottom edge margin of the second wall member being configured for attachment to the base so that the first side margin of the first wall member overlaps the second side margin of the second wall member and the second side margin of the first wall member overlaps the first side margin of the second wall member;

locking tabs connected to at least one of the first and second wall members, the locking tabs being located at respective side margins of the first and second wall members;

locking openings formed in at least one of the first and second wall members, the locking openings being located at respective side margins of the first and second wall members, the locking openings opposing the locking tabs when the first and second wall members are attached to the base to form the perimeter wall of the bulk bin;

the locking tabs being configured to be lockingly inserted into the locking openings to secure the first and second wall members together to form the perimeter wall of the bulk bin;

wherein the locking tabs and locking openings are configured to secure the first side margin of the first side wall member in overlapping relation with the second side margin of the second side wall member and the second side margin of the first side wall member in overlapping relation with the first side margin of the second side wall member; and wherein the locking tabs are configured to bend along fold lines oriented at transverse angles to the respective side margins of the first and second wall members;

wherein each locking tab is inwardly spaced apart from the terminal edge of the respective side margin of the respective one of the first and second wall members and each locking tab is spaced apart between the top and bottom edge margins of the respective one of the first and second wall members.

2. A bulk bin sleeve pack as set forth in claim 1 wherein the locking tabs are configured to be repeatedly inserted into and withdrawn from the locking openings to erect and collapse the perimeter wall assembly.

3. A bulk bin sleeve pack as set forth in claim 1 wherein at least one of the locking openings and one of the locking tabs are located adjacent the bottom edge margin of the perimeter wall.

4. A bulk bin sleeve pack as set forth in claim 3 wherein at least one of the locking openings and one of the locking tabs are located adjacent the top edge margin of the perimeter wall.

5. A bulk bin sleeve pack as set forth in claim 1 wherein each of the locking tabs are hingedly connected to the respective first and/or second wall member.

6. A bulk bin sleeve pack as set forth in claim 5 each of the locking tabs is formed as one piece of material with the respective first and/or second wall member.

7. A bulk bin sleeve pack as set forth in claim 1 wherein the first side margin of the first wall member includes a first of the locking openings and a second of the locking openings;

the second side margin of the second wall member includes a first of the locking tabs and a second of the locking tabs;

the second side margin of the first wall member includes third of the locking tabs and a fourth of the locking tabs; and the first side margin of the second wall member includes a third of the locking openings and a fourth of the locking openings.

8. A bulk bin sleeve pack as set forth in claim 1 wherein each of the first and second wall members is formed from a single board.

9. A bulk bin sleeve pack as set forth in claim 8 wherein each of the boards comprises fluted plastic.

10. A bulk bin sleeve pack as set forth in claim 9 wherein each of the boards has an end panel that forms an end of the perimeter wall assembly and first and second side panels hingedly connected to the end panel and forming opposing side sections of the perimeter wall assembly.

11. A bulk bin sleeve pack as set forth in claim 1 further comprising a strap for girding the first and second wall members when arranged to form the perimeter wall of the bulk bin.

12. A bulk bin sleeve pack as set forth in claim 1 wherein each of the locking tabs comprising a spine portion and a pair of wing portions connected to the spine portion at a free end thereof, the spine portion having a width less than a width of the locking openings and the locking tab at the free end having a width greater than the locking openings.

13. A bulk bin sleeve pack as set forth in claim 1 wherein the first and second wall members are sized to be received in the base in a collapsed configuration of the bulk bin sleeve pack.

14. A bulk bin sleeve pack as set forth in claim 1 further comprising a belly strap.

15. A bulk bin comprising:

a base having a perimeter; and a perimeter wall assembly extending circumferentially around a bulk bin interior and having a top edge margin and an opposite bottom edge margin arranged adjacent the perimeter of the base such that the base defines a bottom end of the bulk bin interior, the perimeter wall assembly comprising a first wall member having a first side margin and a second side margin and a second wall member having a first side margin and a second side margin, the perimeter wall assembly comprising a first interlocking connection securing together the first side margin of the first wall member and the second side margin of the second wall member and a second interlocking connection securing together the second side margin of the first wall member and the first side margin of the second wall member, the first interlocking connection including first and second openings formed in the first side margin of the first wall member and first and second locking tabs extending from the second side margin of the second wall member, the first and second tabs extending through respective ones of the first and second openings and locking the first and second wall members together, the second interlocking connection including third and fourth openings in the first side margin of the second wall member and third and fourth locking tabs extending from the second side margin of the first wall member, the third and fourth tabs extending through respective ones of the third and fourth openings and locking the first and second wall members together;

wherein the first and second locking tabs are bendable about respective parallel fold lines and wherein the first and second locking tabs are configured to be withdrawn from the first and second openings, respectively, by bending about the respective fold lines in opposite directions; and wherein each of the first and third locking tabs has a lower end portion connected to the respective wall member and a free upper end portion and wherein each of the second and fourth locking tabs has an upper end portion connected to the respective wall member and a free lower end portion such that the first and second locking tabs have inverse orientations and the third and fourth locking tabs have inverse orientations.

16. A bulk bin as set forth in claim 15 wherein the locking tabs extend substantially perpendicular to the first and second side margins of the first wall member and the first and second side margins of the second wall member.

17. A bulk bin as set forth in claim 15 wherein the first and third tabs and the first and third openings are located adjacent to the top edge margins of the first and second wall members and the second and fourth tabs and second and fourth openings are located adjacent the bottom edge margins of the first and second wall members.

18. A bulk bin as set forth in claim 15 wherein the base comprises a rim and the bottom edge margins of the first and second wall members being received inside the rim of the base.

* * * * *